United States Patent [19]

Crone, Jr.

[11] 4,257,225

[45] Mar. 24, 1981

[54] EXHAUST GAS TREATMENT TO REDUCE PARTICULATED SOLIDS

[75] Inventor: John M. Crone, Jr., Fishkill, N.Y.

[73] Assignee: Texaco Inc., White Plains, N.Y.

[21] Appl. No.: 949,705

[22] Filed: Oct. 10, 1978

[51] Int. Cl.[3] ..... F01N 3/00

[52] U.S. Cl. ..... 60/274; 60/296

[58] Field of Search ..... 60/274, 311, 303, 299, 60/277, 288, 296; 422/110, 115, 177, 178, 234; 423/212; 55/DIG. 30

[56] References Cited

U.S. PATENT DOCUMENTS

| | | | |
|---|---|---|---|
| 2,985,255 | 5/1961 | Clark | 60/303 |
| 3,440,817 | 4/1969 | Saufferer | 60/299 |
| 3,499,269 | 3/1970 | Bois | 60/297 |
| 3,937,015 | 2/1976 | Akado | 60/311 |
| 4,167,852 | 9/1979 | Ludecke | 60/296 |

FOREIGN PATENT DOCUMENTS

| | | | |
|---|---|---|---|
| 2519609 | 11/1976 | Fed. Rep. of Germany | 60/311 |

*Primary Examiner*—Louis J. Casaregola
*Attorney, Agent, or Firm*—Carl G. Ries; Robert A. Kulason; Robert B. Burns

[57] ABSTRACT

Method for reducing particulated carbon from the exhaust gas stream of an internal combustion engine which includes a combustion supporting ingredient. The particles are initially retained on a gas pervious bed. The latter is periodically treated by passing therethrough a gaseous mixture comprising a major portion of the particle-carrying gas, into which a minor portion of said gas, which has been treated to substantially deplete it of said particles and said combustion supporting ingredients, has been mixed.

4 Claims, 2 Drawing Figures

EXHAUST GAS TREATMENT TO REDUCE PARTICULATED SOLIDS

BACKGROUND OF THE INVENTION

With any internal combustion engine it is desirable to treat the exhaust gases so that they can be safely discharged into the atmosphere. In some engines, particularly the diesel type, one of the operating problems is the presence of solid particles which are carried in the exhaust gas stream.

The particles are normally comprised of bits of carbon. They result from the incomplete combustion of the hydrocarbon fuel mixture under particular operating conditions. However, the operating efficiency of the engine is also a contributing factor to the amount of carbon produced.

The presence of relatively large amounts of carbon particles in any exhaust gas stream is evidenced by a dark, smoky, undesirable effluent. Such smoke is not only offensive to the smell; it can also be undesirable to the environment.

Means have been provided and are known in the prior art, for the elimination, or minimization of the carbon content in exhaust discharge streams. It has been found, for example, that most carbon particles can be eliminated by a suitable filter of proper construction. Eventually, however, the latter can become saturated and/or inoperable due to excessive carbon accumulations.

It should be appreciated that accumulation of carbon particles is prevalent under all diesel engine operating conditions. It is further appreciated that the quantity and quality of an exhaust gas stream created in any internal combustion engine will vary in accordance with the operating characteristics of the engine. For one thing the temperature range experienced by the diesel exhaust gas stream can vary between slightly above ambient air temperature, and temperatures in excess of 1200° F.

Where it is found that an engine continuously operates under such circumstances that carbon is continuously produced and accumulated in the filter, the latter must occasionally be rejuvenated. Under usual engine operating conditions, carbon in the exhaust gas stream as well as any accumulated carbon will be burned off by contact with exhaust gas in excess of 900° F. More precisely, hot exhaust gas will initiate carbon combustion, and the oxygen content of the gas will support the combustion event.

The combustion of any large, and contained carbon accumulation can produce temperatures greatly in excess of the exhaust gas temperature. The result is that at excessive temperatures the filter is susceptible to thermal damage. The latter can be a minor distortion of the bed structure or it can be a major deformation thereof.

Toward achieving a satisfactory or controlled rate of carbon removal from an exhaust gas system without resulting damage to the filter, the unit presently disclosed is provided. The instant filter thus comprises in brief, a reaction chamber through which a hot stream of carbon particle carrying exhaust gas is passed.

During engine operating conditions when the exhaust gas is at a relatively low temperature, such as start-up from cold, the greatest amount of carbon particles will be carried into the filter bed. Heavy carbon deposits will also result from operation under heavy load conditions. In either instance, the exhaust gas stream is introduced to the filter reaction chamber and passed through at least one filter bed.

Within the bed, combustion of the carbon particles is initiated upon contact with the hot exhaust gas. Combustion in the bed is further maintained by the combustion supporting component, particularly oxygen, contained in the exhaust gas. In brief, the greater the oxygen content of the hot incoming gas, the hotter and more rapid will be the burning event within the bed.

Without any restraint on the rate of burning within the bed the latter could, as noted, suffer damage. More particularly, depending on the composition of the bed, the temperature could reach a point where it will cause the bed to be distorted, fractured, or otherwise rendered less efficient than it should be.

To control the rate of burning in the filter bed the flow of combustion supporting gas to the latter is regulated. Thus, the incoming particle carrying gas is supplemented with a stream of gas taken from the filter outlet port. The effect of the gas mixing is that exhaust gas from the engine, which is relatively rich in oxygen, will be intermixed with treated exhaust gas which has been substantially depleted of oxygen by the burning within the filter bed. Thus, with the reduced amount of oxygen present, the further burning of the carbon particles will be at a much slower rate. This will lessen the opportunity for the bed structure to be thermally damaged.

It is therefore an object of the invention to provide a method for operating an internal combustion engine wherein the hot exhaust gas is treated to remove solid matter. Another object is to provide a filter member for an internal combustion engine which is capable of being safely rejuvenated by removal of carbon from the filter bed. A further object is to provide a filter of the type disclosed wherein burning of carbon within the filter structure is controlled by regulation of the combustion supporting element which is passed through the filter. A still further object is to provide an exhaust system of the type contemplated wherein an exhaust filter is periodically treated to remove carbon, and the burning of the latter is controlled by intermixing of particle carrying exhaust gas with a stream of non-combustion supporting gas. In the preferred practice of the invention, a hot, particle containing exhaust gas stream is passed through a particle retaining bed. In the latter, at least a part of the contained particles are removed by retention on the filter bed walls and passages.

Hot exhaust gas is introduced to the bed to burn the retained particles. However, the rate of such combustion is regulated by varying the composition of exhaust gas entering the bed.

Said exhaust gas thus comprises a mixture of hot gas from the engine, which is mixed with treated exhaust. The latter is in a condition of being substantially free of carbon particles as well as combustion supporting gas such as oxygen.

DESCRIPTION OF THE DRAWINGS

In the drawings, FIG. 1 illustrates an internal combustion engine 10 wherein a hydrocarbon fuel is intermixed with air to form a combustible charge. It is appreciated that the instant filter 11 can be utilized with a number of different types of engines for removing solid particles. However, it is particularly adapted for use with a diesel engine.

Figure 1:
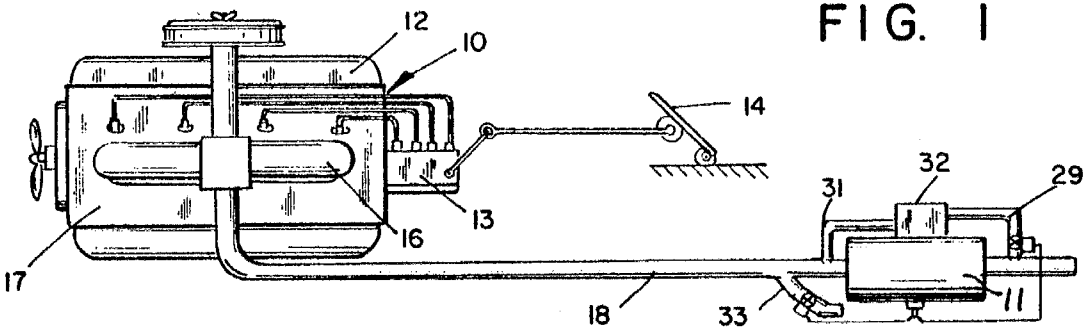
FIG. 1 is an environmental sketch of the instant exhaust system used in conjunction with an internal combustion engine.
Figure 2:
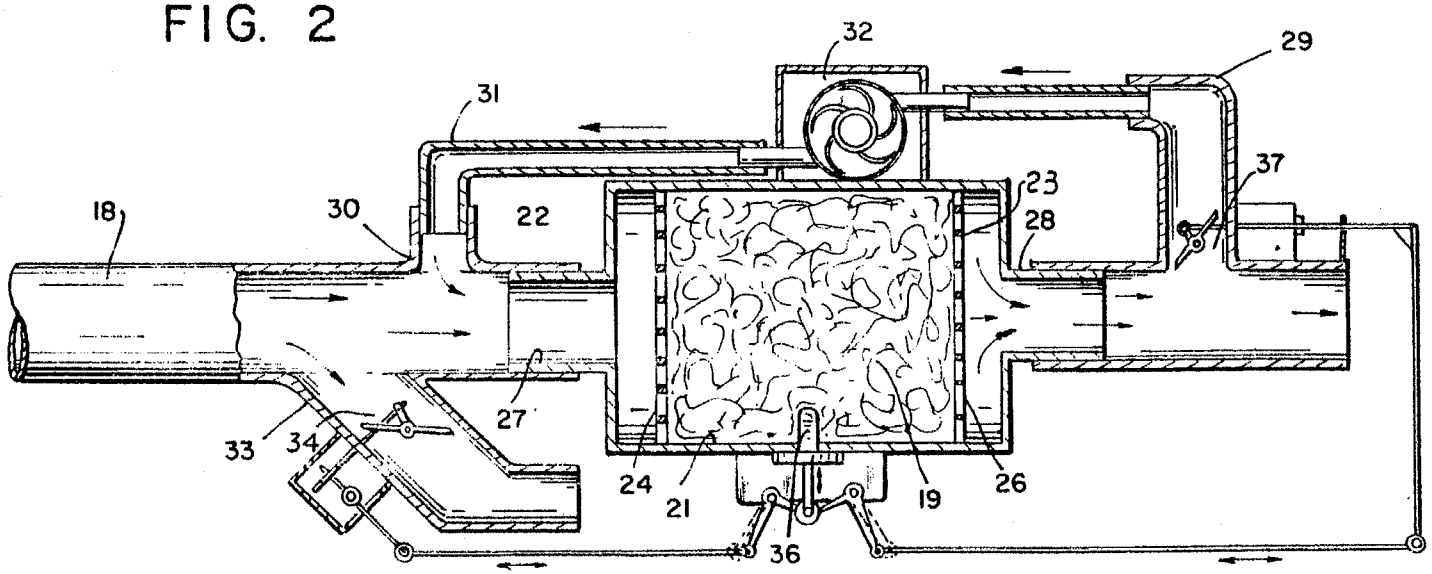
FIG. 2 is an enlarged view in cross section of the filter element.

Thus, to facilitate the present description, the engine, or source of exhaust gas, will be considered to be of the diesel type. In the latter, air is sequentially introduced to the various combustion chambers from a manifold 12. Fuel is thereafter injected into each combustion chamber from a fuel pump 13 by way of a control linkage 14. A hot exhaust gas stream is carried from exhaust manifold 26 and conducted through an exhaust pipe 18 to the smoke filter 11. Although a sound muffler could be inserted in exhaust pipe 18, such an element is not essential in the instant system.

As herein noted the exhaust gas, subsequent to leaving exhaust manifold 17, will be at a temperature within the range of about 400° to 1200° F. depending on the operating conditions of the engine. For example, at low and idle speeds, the exhaust gas will be relatively cool or only slightly heated. This will result in very little of the carbon particles being burned from the stream itself. Consequently, as the exhaust gas enters filter 11, the particulate carbon carried on the stream will be retained along the many diverse passages within filter bed 19.

Filter 11 comprises in essence an elongated casing 21 having opposed end walls 22 and 23 which define an internal reaction chamber. The latter chamber is occupied to a large extent by at least one bed 19 formed of a material particularly adapted to provide a plurality of irregular passages. The function of said bed 19 is to define a series of passages along which the gas will pass such that particles in the stream will be retained on and along the passage walls.

In one embodiment, bed 19 can be formed of a metallic, mesh-like mass, such as steel wool or the like, which is shaped to substantially fill the filter reaction chamber.

Bed 19 can be optionally supported at its upstream and downstream ends by perforate panels 24 and 26, or other similar transverse members. The latter are carried on the casing wall 21 to support the single bed 19 therebetween.

The filter 11 upstream wall 22 is provided with an inlet port 27 for introducing gas to the upstream side of bed 19. In a similar manner the downstream panel 26 is communicated with outlet port 28, to carry away gases which leave bed 19.

Filter 19 is further provided with a valved bypass means adapted to carry a desired amount of the particle-free gas from the filter outlet port 28, for recirculation through the filter bed 19. Said bypass means comprises in essence a first conduit 29 which is communicated with discharge port 28. A second conduit 31 is communicated with exhaust pipe 18 at a junction point 30 upstream of the filter and adjacent to inlet port 27.

Said respective conduits 29 and 31 are each connected into a flow inductor 32 such as a blower, or a small compressor. The latter is actuated as required, to induce or promote the flow of particle-free gas through the bypass circuit to establish a pressure differential between the outlet port 28 and inlet port 27. This actuation is prompted when the bed 19 temperature commences to rise in response to rapid oxidation of trapped carbon.

Exhaust pipe 18 is further provided with a lateral passage defined by a venting pipe 33 or the like having a venting valve means 34. The latter valve 34 is adapted to be manipulated, or opened, to divert a part of the stream of particle containing exhaust gas. In effect, a minor portion of the latter will be diverted so as not to flow through filter 11.

Functionally, valve 34 is actuated when it becomes necessary to decrease the supply of oxygen to the filter bed 19. This throttling of the combustion supporting element will prevent the bed temperature from rising beyond a predetermined level. Valve 34 can further be used as a pressure relief device to prevent the engine from operating against an excessive back pressure.

Said venting pipe 33 is preferably disposed upstream of both junction 30 and inlet port 27. Thus, the overall flow of hot gas along exhaust pipe 18 can be reduced by actuating the venting valve 34. When adjusted to the open or partially open position, the valve will permit a discharge of a portion of the overall particle carrying exhaust gas flow.

Downstream of venting pipe 33, at junction 30, the minor stream of particle-free, oxygen-lean gas is introduced to the main exhaust gas flow. The two streams will thereby form an aggregate which, in composition, comprises carbon particles, together with oxygen-lean exhaust gas.

The overall composition of the aggregate gas stream will be adjusted with respect to the volumetric amount of combustion supporting gas contained therein. As the oxygen-lean gas stream is introduced to filter bed 19 the rate of particle burning within the bed will be reduced or choked down. The resulting bed temperatures can thereby be maintained within a harmless range.

To assure the desired controlled rate of carbon burning within filter bed 19, one or more temperature sensing means 36 are disposed about the filter interior. These are preferably within the filter bed itself. Such temperature sensors 36 are preferably connected through the necessary electrical circuitry to the electrically actuated venting valve 34, as well as to the similarly actuated flow diverter valve 37.

Thus, both of said valves 34 and 37 are ideally operated simultaneously in response to a temperature condition within filter bed 19. As the temperature within bed 19 rises due to an excessive rate of carbon combustion therein, the temperature sensor 36 will respond. Said member will cause the venting valve 34 to open thereby permitting a flow of the hot, particle carrying exhaust gas to be diverted from the exhaust main stream and away from filter bed 19.

Simultaneously, diverter valve 37 downstream of the filter 11 will likewise be adjusted such that the particle-free stream which leaves outlet port 28 will be diverted in part. Thus, at least a portion of the gas flow will enter the bypass conduit means to be recirculated and thereafter be induced through blower 32 to flow into and mix with the main exhaust stream at the filter inlet port 30.

At such time as the carbon or other solid particles are completely burned from filter bed 19 the intermixing of the exhaust gas with particle-free gas at the filter inlet 32 can be discontinued. However, at such time as an accumulation of carbon again commences to build within the filter bed 19, there will be a resulting decrease in the overall gas flow through the filter providing an indication of said build-up. At such an indication the process can be repeated until the carbon accumulation is completely disposed of.

There are a number of conditions under which there will be a tendency for carbon bits and particles to accumulate within the filter bed 19. Further, as herein noted, this accumulation can be disposed of in one embodiment through the use of exhaust gas from the engine which is generating the exhaust.

It is appreciated,, however, that the rejuvenation of filter member 11, when in a carbon-filled condition, can be achieved even though it does not receive an exhaust gas stream from the operating engine. In such an instance, gas from an external source, preferably without a substantial carbon content, will be introduced to the inlet of the filter 11 at a sufficient temperature to initiate combustion of the retained carbon. However, to control this combustion event, the present arrangement can still be utilized such that carbon-free gas which is discharged from the filter outlet will be diverted to the filter inlet. As in the previous operation the overall quantity of combustion supporting gas entering the filter bed will be reduced, thereby to limit the rate of carbon burning.

Other modifications and variations of the invention as hereinbefore set forth can be made without departing from the spirit and scope thereof, and therefore, only such limitations should be imposed as are indicated in the appended claims.

I claim:

1. Method for removing combustible particles from the hot exhaust gas stream having a combustion supporting ingredient therein, which includes the steps of;

passing said hot exhaust gas stream carrying combustible particle through a particle-retaining bed leaving the latter substantially free of said particles and said combustion supporting ingredient, recycling a portion of the exhaust gas stream leaving said bed to mix with the hot particle-carrying exhaust gas at a point upstream of said bed, forming a diluted gaseous mixture comprising a major portion of the hot exhaust gas stream, and a minor portion of said exhaust gas which is substantially free of said particles and said combustion supporting ingredient, and introducing said diluted gaseous mixture into said particle-retaining bed whereby to limit the rate at which retained particles are combusted.

2. In the method as defined in claim 1, including the step of;

concurrently recycling a portion of the gas leaving said bed, and diverting an amount of hot particle-carrying gas.

3. In the method as defined in claim 1, including the step of;

pressurizing said recycled stream of particle-free gas prior to intermixing thereof with said particle carrying gas.

4. In the method as defined in claim 1, including the step of; establishing a reduced pressure downstream of said particle-retaining bed to induce said amount of substantially particle-free gas therefrom.

* * * * *